United States Patent [19]

Hall

[11] 4,441,626

[45] Apr. 10, 1984

[54] PIZZA BOX

[75] Inventor: Robert E. Hall, Wheaton, Ill.

[73] Assignee: Fidelity Grafcor, Inc., Elk Grove Village, Ill.

[21] Appl. No.: 330,674

[22] Filed: Dec. 14, 1981

[51] Int. Cl.[3] ..... B65D 81/24; B65D 81/26

[52] U.S. Cl. ..... 220/443; 220/458; 229/2.5 R; 229/31; 229/33; 229/DIG. 14; 426/127

[58] Field of Search ..... 220/441, 443, 418, 458; 229/2.5 R, 3.1, 33, 36, DIG. 14; 206/550, 545; 426/127, 124; 428/186

[56] References Cited

U.S. PATENT DOCUMENTS

| | | | |
|---|---|---|---|
| 1,184,749 | 5/1916 | Hicks | 428/186 |
| 1,449,409 | 3/1923 | Hunt | 220/443 X |
| 1,865,742 | 7/1932 | Chapman | 229/2.5 R |
| 1,945,397 | 1/1934 | Gray | 229/2.5 R |
| 1,974,898 | 9/1934 | Rutledge | 229/2.5 R |
| 2,164,025 | 6/1939 | Schwertfeger | 220/464 X |
| 2,278,782 | 4/1942 | Harvey et al. | 220/411 X |
| 2,434,466 | 1/1948 | Marc | 428/186 X |
| 2,470,465 | 5/1949 | Broeren et al. | 426/127 |
| 2,497,203 | 2/1950 | Bennett | 426/127 |
| 2,782,977 | 2/1957 | Thompson | 220/441 |
| 3,067,921 | 12/1962 | Reifers | 229/2.5 R |
| 3,145,904 | 8/1964 | Bromley | 220/76 X |
| 3,291,367 | 12/1966 | Carter | 229/33 |
| 3,876,131 | 4/1975 | Tolaas | 206/491 X |
| 4,058,214 | 11/1977 | Mancuso | 229/2.5 R X |
| 4,237,171 | 12/1980 | Laage et al. | 229/33 X |

*Primary Examiner*—Allan N. Shoap

*Attorney, Agent, or Firm*—Laff, Whitesel, Conte & Saret

[57] ABSTRACT

A box is formed from a unitary, double-sided corrugated cardboard blank having a plurality of scored lines which enable a set up in box form. A bottom panel of the box has cemented thereto a single-sided, fluted corrugated cardboard medium with the fluted side facing upwardly. A moisture-resistant glue is used between the smooth faces of the fluted corrugated medium and the confronting liner of the blank to provide an impenetrable barrier which prevents grease from penetrating through the box. The boxes are manufactured on a conventional production line which is modified by, in effect, running one stage in a reverse direction in order to invert the single-sided medium and to apply the glue in a different manner to establish the moisture barrier.

9 Claims, 12 Drawing Figures

TO FIG.5A
98
104
CORRUGATING ROLLS
MEDIUM
108
GLUER
92
104
LINER
106
PRE-HEATER
100
99
LINER
97
99
102
GLUER
90
97
CORRUGATING ROLLS
MEDIUM

96

PVA GLUER
112
114
110
97
99
104
98
LINER
94
FROM FIG.5

PIZZA BOX

This invention relates to boxes for packaging foods, and more particularly, to boxes for packaging and maintaining the temperature of foods such as pizza, in an optimal state, as during delivery, for example, and to methods for making the boxes.

Hereinafter, it will be convenient to refer to pizza boxes, by way of example. However, the invention is equally applicable to any of many similar foods, products, or the like, especially when it is desirable to keep the foods or products elevated above any liquid dripping off the foods or products. The box is designed to retain the temperature of either hot or cold food, or the like, over an extended period of time.

Conventional pizza boxes do not enable good air circulation or heat retention. They do not prevent a penetration of grease through the box. As a result, both the boxes and pizzas are often delivered in a soggy condition resulting in either damage to the pizzas or inconvenience to anyone or anything with which the boxes come in contact. Sometimes, the pizzas may be delivered inside large paper bags which can maintain the heat of the pizzas for only a few minutes. Usually, inserts in the form of corrugated cardboard discs must be added to the boxes or the bags. Thus, present day pizza boxes do not provide for delivery of pizzas in the same condition that they have when taken from the oven. These boxes require excessive set-up time for erecting boxes, installing inserts, etc.

Accordingly, an object of the invention is to provide new and improved packaging boxes, and particularly, food packaging boxes. More particularly, an object is to provide boxes which will enable grease or other liquids to drip or wick off pizzas, but not to penetrate through the boxes.

Here, an object is to provide boxes which help enable delivery of pizzas in a crisp, optimal state, without creating a greasy condition which may stain clothes, car seats, or the like.

Another object is to provide easy-to-assemble pizza boxes which set up with minimum effort, require no inserts, and enable a good air circulation and heat retention. Yet another object is to provide a method for assembling such pizza boxes.

In keeping with one aspect of this invention, a box is formed from a unitary, double-sided corrugated cardboard blank having a plurality of scored lines to enable a quick and easy folding of panels to set up the box form. The bottom panel of the box has a single-sided, fluted corrugated cardboard medium glued to the double-sided corrugated cardboard blank. The fluted side of the medium faces upwardly, out of the box. A moisture-resistant glue is used between the smooth faces of the fluted corrugated medium and the confronting liner of the blank to provide an impenetrable barrier which prevents grease from penetrating through the box. The boxes are manufactured on a conventional production line which is modified by, in effect, running one stage in a reverse direction in order to invert the single-sided medium and to apply the glue in a different manner to establish the moisture barrier.

The invention will be best understood by reference to the following description of an embodiment of the invention taken in conjunction with the accompanying drawings, in which.

Figure 3:
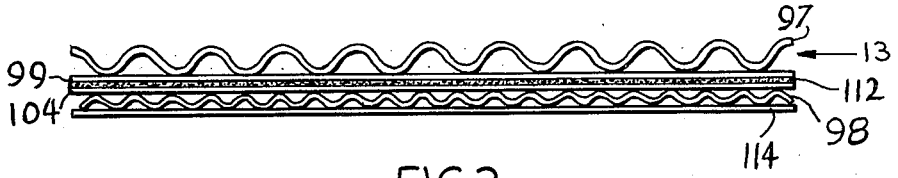
FIG. 3 is a cross-section of the inventive box taken along line 3—3 of FIG. 2.
Figure 3A:
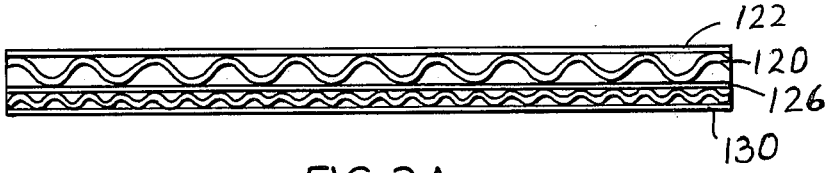
FIG. 3A (PRIOR ART)
FIG. 3A is a cross-section of a conventional double-layer corrugated liner.
Figures 5, 5A:
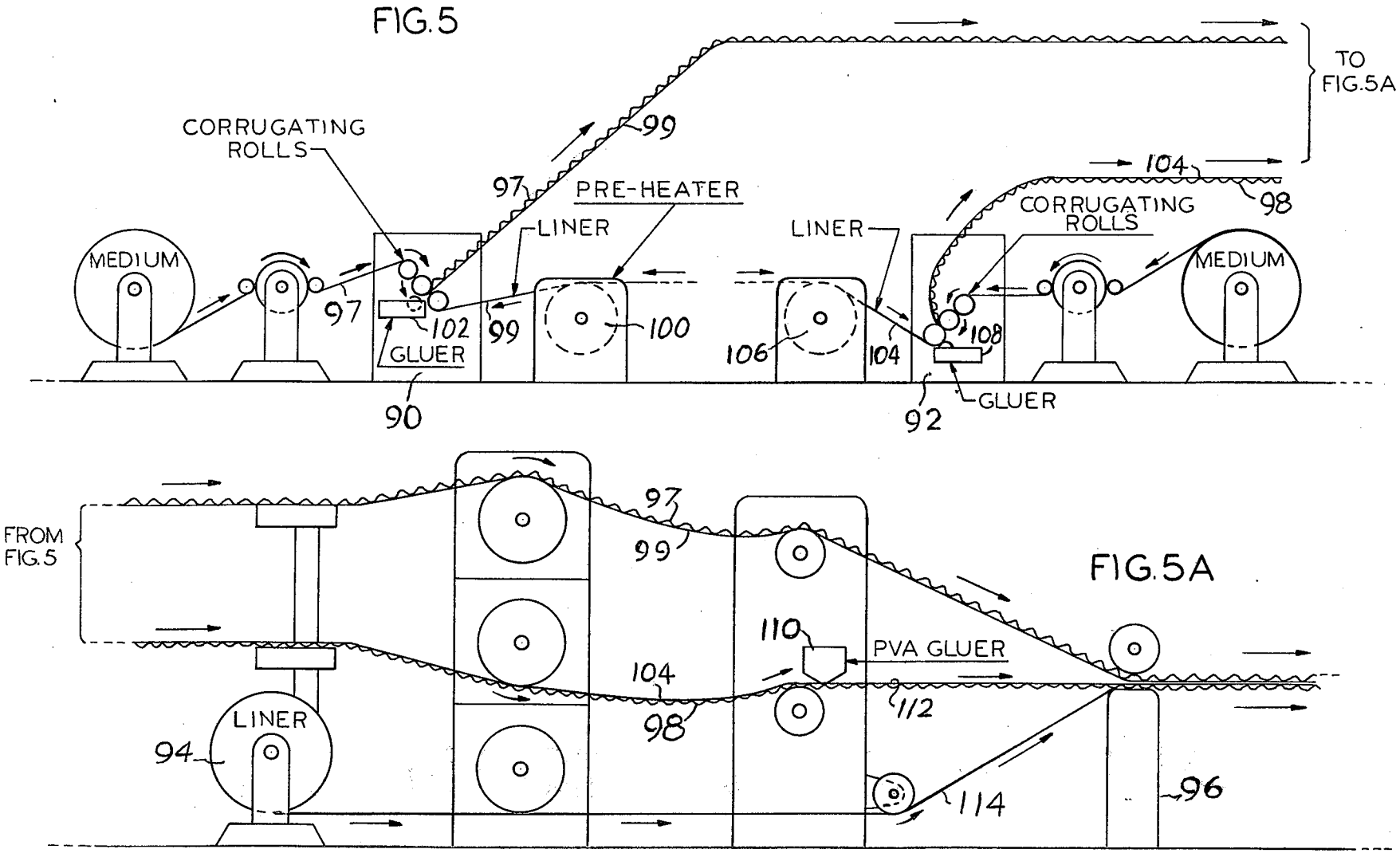
Figure 7:
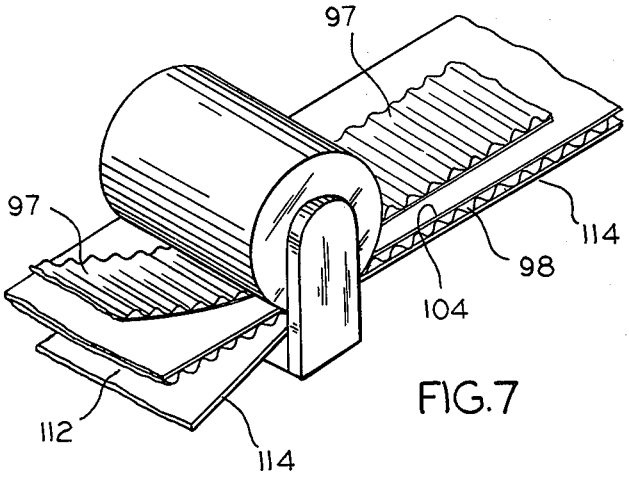
Figure 8:
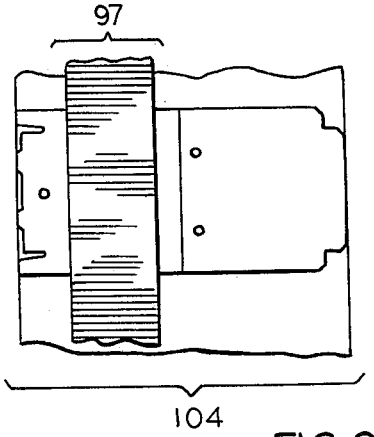
Figure 9:
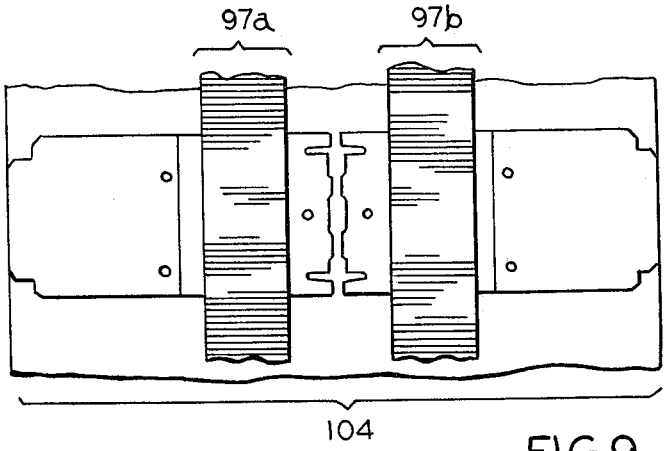
Figure 6:
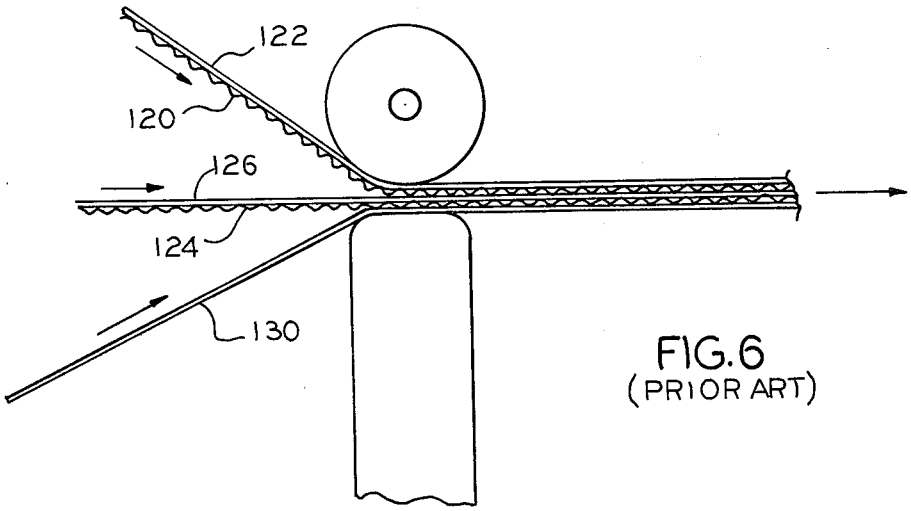
FIG.6 (PRIOR ART)

FIGS. 5 and 5A together show a diagrammatic view in side elevation of a corrugation cardboard production line for making the inventive box with a liner having upstanding flutes, such as that shown in FIG. 3;

FIG. 6 is a view of a work station in FIG. 5, showing a conventional method of making a double-layer corrugated liner, such as that shown in FIG. 3A;

FIG. 7 is a perspective view of the last work station in the production line of FIG. 5;

FIG. 8 is a plan view of the product of the production line, of FIG. 7, showing how the blank is cut for large boxes; and FIG. 9 is a similar plan view showing how the blank is cut for smaller boxes.

Figure 1:
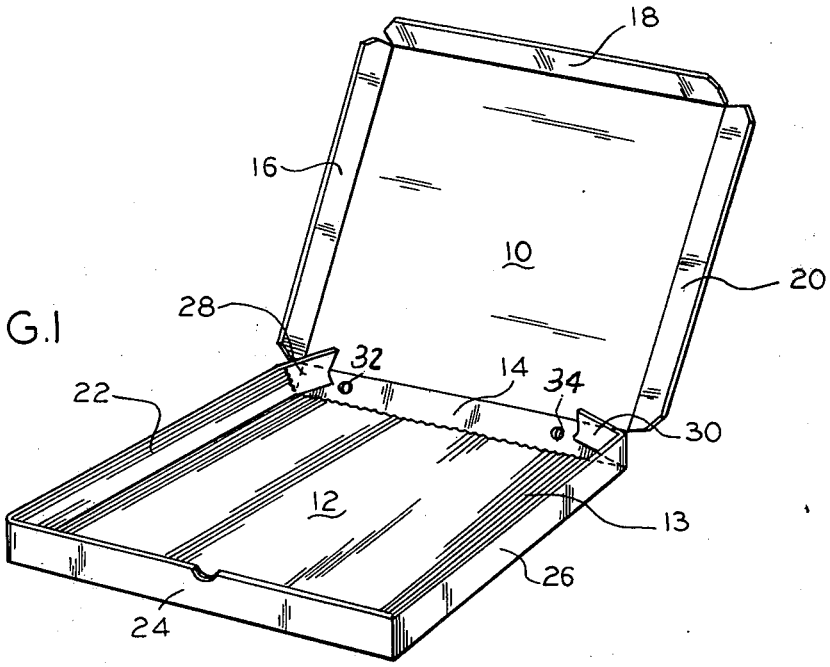
FIG. 1 is a perspective view of the erected box, in an open position.

As shown in FIG. 1, a pizza box constructed in accordance with the teachings of this invention comprises upper and lower members having a top panel 10, a bottom panel 12 and a central panel 14. The top panel 10 and the bottom panel 12 include side panels 16, 18, 20, 22, 24, 26 and various side flaps 28, 30, to complete the folding and assembly of the box.

If the pizza box described thus far is made of conventional corrugated cardboard, it is subject to two faults. First, bottom panel 12 does not prevent grease from penetrating through the box. Thus, a pizza which drips causes stains on clothes, auto seats, or anything else which may come into contact with the box. Second, the flat smooth surface of the bottom panel 12 does not provide for good air circulation and heat retention in the area under the pizza which leads to a soggy crust.

In keeping with one aspect of this invention, means are provided for preventing grease penetration and for enabling air circulation within the pizza box, and especially under the crust. In greater detail, a corrugated cardboard medium 13, with the upstanding flutes is glued to the bottom panel 12 with a moisture-resistant glue which forms an impenetrable layer or moisture barrier. The upstanding flutes are made of a material which wicks grease; thus grease not only drips, but also is positively wicked off the pizza and into the medium. However, that grease cannot penetrate through the layer of moisture resistant glue. The pizza and the box are kept in an optimal state. Air can also circulate around the pizza since it is held up and supported on the tops of the upstanding flutes of the corrugated medium, and out of any pool of grease or other liquid which may form in the bottom of the box.

Figure 2:
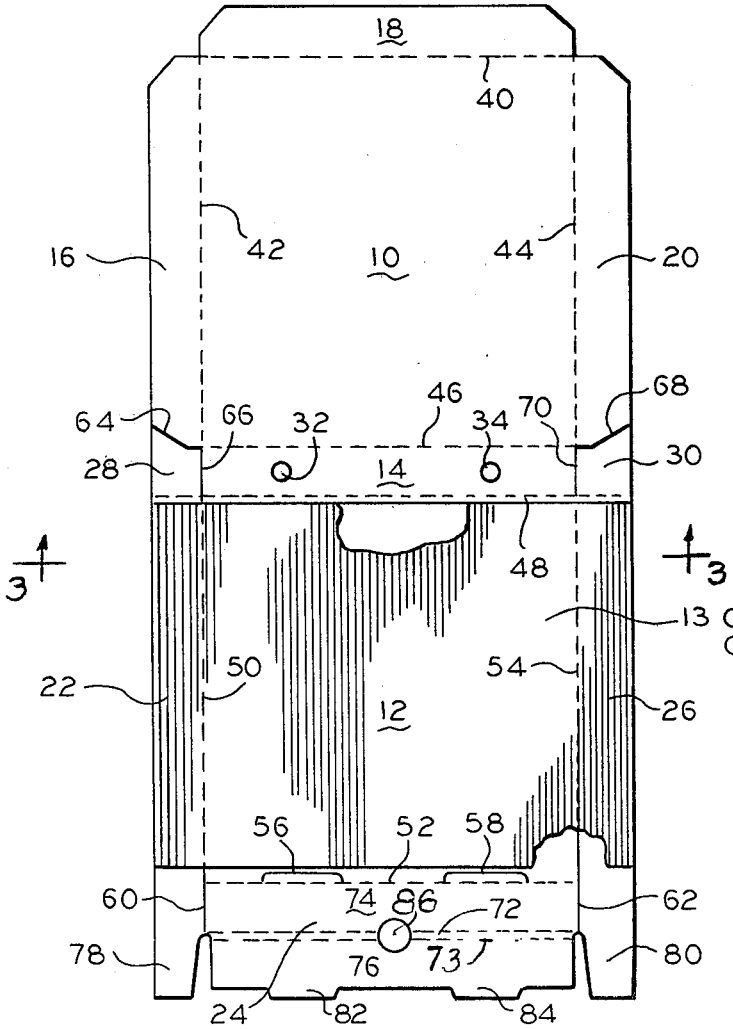
FIG. 2 is a plan view of a blank for the unerected box.
Figure 2A:
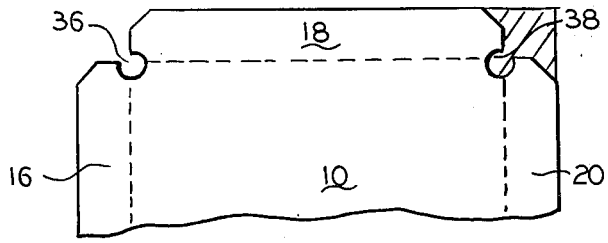
FIG. 2A is a view of the top panel of FIG. 2 which shows an alternative cutting of the box for ventilating the box without requiring holes made from loose parts.

According to the invention, means are also provided for venting the box either at holes 32, 34 in FIG. 2 or at several selvage enlargements which are cutout at 36, 38 when the blank is formed (FIG. 2A). Research has found that proper ventilation should be attained inside the box to keep the pizza hot and still retain good crust quality, when approximately one square inch of ventilation is provided for each cubic foot of volume, to acquire a proper balance between heat and steam. Therefore, the size of the holes or cutouts is selected to enable just enough steam to escape to prevent the pizza from becoming soggy, but not so much that the pizza box will lose heat. Conveniently, the venting area may be controlled by selecting a correct number of holes so that one size punch will serve all box sizes.

FIG. 2 shows the basic, unitary blank for making the folded pizza box. The top panel 10 is defined by a plurality of scored lines 40, 42, 44, 46. The bottom panel 12 is defined by scored lines 48, 50, 52, 54. The bottom panel 12 has a medium 13 of single-faced corrugated cardboard glued to it with the exposed flutes facing upward as viewed in FIGS. 1, 2 and 3. In this embodiment, the top 10 and bottom 12 are joined by a central side panel 14 containing holes 32, 34 for venting steam without an undue loss of heat.

In FIG. 2, dashed lines are used to indicate where scoring forms fold lines and solid lines are used to indicate where blank cutting occurs. A semi-piercing rule die is used to form an alternating cut and score line at 46, non-cutting rule dies form score lines elsewhere as indicated by dashed lines (e.g. line 42), and cutting rule dies cut through the blank as indicated by solid lines, as at 56, for example. The cutouts are formed at points 56–70 to make locking tabs and to reduce binding where the folding cardboard would otherwise form undue bulk, bind, or prevent smooth folds.

These score and cut lines divide the top panel 10 into matched side panels 16, 20 and an end panel 18, and divide the bottom panel 12 into matched side panels 22, 26, and a double end panel 24 divided by a scored line 72 into panels 74, 76. Folding corner tabs or panels 78, 80 are formed on ends of the side panels 22, 26 at the front of the bottom panel 12 of the box. Corner tabs or panels 28, 30 are formed at the opposite ends of the side panels 22, 26 to hinge, fold inside, and support the sides and corners of the box. The corner tabs or panels 28, 30, 78, 80 enable and cause the side and end panels 14, 22, 26, 74, 76 to articulate and lock into a box configuration. A pair of locking tabs 82, 84 fit into cutouts at locations 56, 58 while tabs 78, 80 are captured between end panels 74, 76, for locking the bottom panel 12 of the box into its fully-folded condition.

To fold and assemble the box, the side panels 22, 26 are first folded upwardly and out of the plane of the paper at lines 50, 54, as viewed in FIG. 2. The corner panels 28, 30, 78, 80, are folded inwardly toward the center of the box. Next, the double end panel 24 (divided into panels 74, 76) is folded at line 52 upwardly out of the plane of the paper, and the panel 76 is then folded along two scored lines 72, 73 downwardly, over inturned corner panels 78, 80, and into the box where locking tabs 82, 84 fit into the cutouts 56, 58. Finally, side panels 16, 20 and end panel 18 are folded along lines 42, 44, 40 up out of the plane of the paper as shown in FIG. 2. The entire top panel 10 is then folded, at line 46, upwardly, out of the plane of the paper as shown in FIG. 2. The side panels 16, 20 and end panel 18 tuck neatly into the bottom of the box. The circular hole punched at point 86 folds in half to provide a semi-circular cutout when panel 24 is folded along lines 72, 73 to provide a place where a person can place a thumb nail for an easy opening of the box.

FIG. 2A shows an alternative venting of the box wherein selvage cutouts 36, 38 replace holes 32, 34. A possible problem with punched holes 32, 34 is that a cutout disc is formed which may not lift completely out of the remaining hole. If this should happen, someone could eat the disc. Thus, the corner cutouts 36, 38 are desirable because each "disc" forming a hole is integral with a corner member (the selvage is cross-hatched in FIG. 2A) which may be removed as a unit so that there is no clean-out problem requiring a removal of the cut disc portions, such as might be required at 32, 34. Thus, it is seen that, while present day machinery includes a certain amount of risk that the discs forming holes 32, 34 will not be cleaned out properly, the embodiment of FIG. 2A completely removes that risk. Therefore, none of the discs may fall into the box to be swallowed by a person who is eating the pizza.

Figure 4:
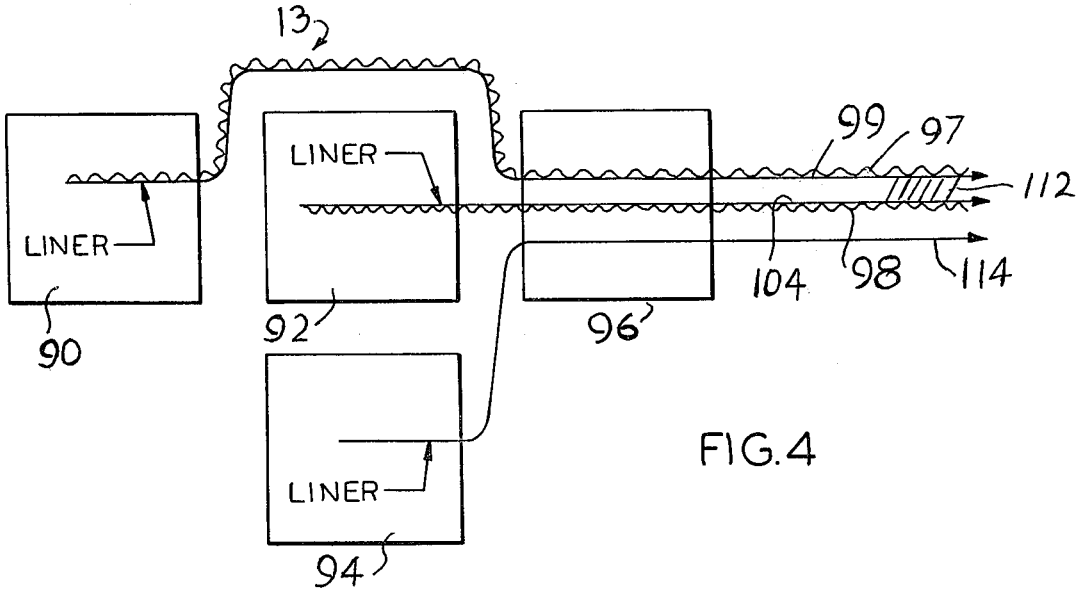
FIG. 4 is a block diagram of a production line for constructing the inventive box.

The inventive production method of gluing the corrugated cardboard medium 13 is shown in the block diagram in FIG. 4. The back of corrugated cardboard medium 13 (with upstanding flutes) is cemented to and becomes integral with the bottom panel 12, and with the fluted side of the cardboard medium 13 facing upwardly. More particularly, at a first work station 90, an upper flute corrugated, single-face board is formed. At another work station 92, a lower flute corrugated, double-face board is prepared. At work station 96 the smooth faces of the liners of the upper fluted single-face board and the lower fluted corrugated double-face boards are glued together with the use of a moisture resistant adhesive. The upper flutes are upstanding and a moisture resistant layer (shown by cross-hatching 112) is formed inside the box. Work station 94 supplies a liner which is also added at work station 96 to complete the bottom of the double-faced corrugated board as shown in FIGS. 3 and 4.

The preferred embodiment (FIG. 3) uses "B" and "E" flutes for the upper and lower flutes 97, 98, respectively. By industry standards, a "B" flute is relatively large, perhaps one-eighth inch in height, while an "E" flute is relatively small, about one-sixteenth inch in height. However, these particular dimensions are not critical and other flute sizes could be used.

A more detailed view of the production line of FIG. 4, for making the inventive box, is shown in FIG. 5 (with FIG. 5A placed to the right of and joining FIG. 5).

At work station 90, a bleached white medium is corrugated into upper (preferably "B" size) flutes 97. The bleached medium 97, which comes into direct contact with the pizza is sanitary, and has a clean, fresh look (as compared to conventional brown Kraft paper). The medium 97 is then glued to a liner 99 pulled from a roll 100 of heavy Kraft paper. The bleached white flutes 97 are preferably adhered to liner 99 by a regular water resistant starch adhesive, altered by the addition of Ketones. The Ketones create an adequate moisture resistance to prevent delamination of the flute tips from the liner when the steam and grease from the pizza come into contact with them.

More particularly, the adhesive is added by glue applicator roll 102. Since, the corn starch adhesive is not moisture-proof, pizza grease is able to both wick through the corrugated medium and drip into the bottom of the flutes. The flutes 97 should be large enough, for any food resting thereon, to be above any pool of grease or juices collected in the bottoms of the flutes.

At work station 92, an unbleached Kraft paper medium is corrugated to form lower (preferably "E" size) flutes 98. The "E"-fluted medium 98 is then glued to a heavy Kraft paper liner 104 from spool 106 with a conventional corn starch glue. The glue is added by glue applicator roll 108. It should be noted that upper flutes 97 face upwardly while lower flutes 98 face downwardly so that the smooth liners 104, 99 form first and second substantially flat surfaces which come into face to face contact. The upper fluts 97 comprises a plurality of upwardly directed riges defining therebetween open channels which are upwardly directed to convey heat and steam from under the pizza and toward vents 32, 34 or 36, 38. The flat surface 104 is the upper surface of any suitable support layer, here elements 114, 98, 112, by way of example.

The two, single-faced corrugated cardboards, thus formed at work stations 90, 92, are transported in a more or less spaced parallel relationship to another work station 96 where the smooth faces 99, 104 of the liner are laminated together, with a moisture-resistant glue 112 from gluer 110 which forms the moisuter barrier. The glue preferably used to bond the two liners 99, 104 to each other is a P.V.A. type adhesive 112 which creates a grease and moisture barrier. The P.V.A. adhesive conforms with the composition requirements of the FDA Food Additives Regulation 175.105 for food packaging adhesives. A bottom liner 114 pulled from spool 94 is then glued to the lower fluted edge of medium 98 with a conventional corn starch glue, to complete the lower surface of the inventive material.

A station from a conventional production line for a double corrugation board is shown in FIG. 6, and the end product of this conventional production line is seen in FIG. 3A. A corrugated medium 120 is glued to a liner 122, with the flutes facing downwardly. Another corrugated medium 124 is glued to the heavy Kraft center paper liner 126 with its flutes also facing downwardly. Then, the fluted medium 120, with attached liner 122 is glued to the top of center paper liner 126 and a lower liner 130 is glued to the bottom of the double board. The single sheet 126 is not covered with any moisture barrier and there is no space for an insertion of the barrier.

Compare FIGS. 3 and 3A, where the two liners 99, 104 are in a face to face relationship with the inventive moisture barrier 112 formed between them. There is no way of placing the moisture barrier between two face-to-face liners in the layer 126, by the conventional production methods since flutes 120 conventionally point downwardly and there is only one liner in the center. The inventive flutes 97 point upwardly and there are two liners 99, 104 in the middle.

The inventive method achieves this result by, in effect, running work station 90 in a "backward" direction so that the medium 97 and liner 99 are manufactured in an upside down orientation. More particularly, there is no need to physically turn the corrugating machine around in order to run it in a "backward" direction. These corrugation machines may conventionally be given either a "left-hand" or a "right-hand" drive, depending upon the layout of a production line. The "upside down" layer 97, 99 may be made by, in effect, using a "left-handed" drive on a "right-handed" production line, or vice versa. Hence, an advantage of the invention is that a conventional corrugation production line may be re-set in an unconventional manner to produce the inventive box without requiring anything more than set-up time.

FIGS. 7–9 show how the insert layer of upwardly pointing flutes are formed in only the bottom of the box. In greater detail, (as best seen in FIGS. 7 and 8) the E-fluted medium 98 which makes the double-faced corrugated cardboard 104, 114 has a full width, corresponding to the length of the blank of FIG. 2. The insert of upwardly pointing flutes 97 has a restricted width, corresponding to the width of the bottom 12.

Thus, the die for cutting the blank of FIG. 2 is positioned across the width of the product, as best seen in FIG. 8. Those portions of the blank which form the top 10 and the double end flap 24 are punched from the conventional double-sided corrugated cardboard 104. The insert material having upwardly pointing flutes 97 are located in only the bottom area 12. Thus, when the blank is cut, as shown in FIG. 8, the insert automatically appears at the desired location, without requiring any extra labor.

The widths of the panel 104 and insert 97 may be made wider or more narrow to accommodate different box sizes. However, the boxes may become so small that it is no longer economically feasible to operate the production line. When this happens, two inserts 97*a*, 97*b* are cemented onto the conventional cardboard 104, as best seen in FIG. 9. Thus, two blanks are cut, end to end, or nested in a material saving manner. Likewise, any suitable number of insert stripes and of smaller boxes may be cut across the width of the cardboard, in a similar manner.

The many advantages of this pizza box should now be self-apparent. First, the exposed upstanding upper flutes enable grease to wick and flow off the pizza and into the lower areas of the box. The pizza is held at an elevation above the grease to keep it from becoming soggy. The upstanding corrugation also enables heat retention within the box while maintaining good air circulation around and under the pizza. Second, the moisture-resistant PVA adhesive, used to laminate the upper and lower single faced cardboards together, traps and prevents the pizza grease from penetrating through the box. Third, the size of the holes 32, 34 or cutouts 36, 38 enables controlled amounts of steam to escape, which might otherwise cause the pizza crust to lose crispness, and yet the holes or cutouts are small enough to retain the heat of the pizza. Of course, there are still other advantages which will be apparent to those skilled in the art.

While the principles of the invention have been described above in connection with specific apparatus and applications, it is to be understood that this description is made only by way of example and not as a limitation on the scope of the invention, and the claims are intended to cover all equivalents.

I claim:

1. A box comprising upper and lower members which close or open relative to each other to form a covered box, a bottom of said box being formed by said lower member and comprising three laminated layers, a first and outside one of said three laminated layers forming a supporting layer having a first and substantially flat surface on its interior side, a second and intermediate one of said three laminated layers extending over at least a substantial portion of said first flat interior surface, said second layer comprising barrier layer means resistant to at least moisture and being spread across the said first flat interior surface, a third and inside one of said three layers having a second and substantially flat surface on its lower side with a plurality of spaced parallel flutes upstanding on its upper side, said first and second flat surfaces being bonded together in a face to face relationship with said barrier layer means interposed therebetween, said flutes comprising a plurality of upwardly directed ridges defining therebetween upwardly directed open channels, said ridges forming means for supporting an article above the bottoms of said channels, and venting means formed in said box and located in a side wall of said box at the ends of said channels, the dimensions of said box being such that heat from an article resting on said flutes escapes through said ventilation means via said channels.

2. The box of claim 1 wherein said barrier layer means is an adhesive.

3. The box of either of the claims 1 or 2 wherein said flutes are made of a corrugated cardboard medium having a liner cemented to its lower tips and said barrier layer means is a water and grease resistant glue spread between the liner and the bottom of said lower member.

4. The box of claim 3 wherein said box is made from a unitary blank of double sided corrugated cardboard.

5. The box of either of the claims 1 or 2 wherein said flutes are bleached paper and said barrier layer means is a P.V.A. adhesive.

6. The box of any either the claims 1 or 2 wherein said flutes are made of paper which wicks moisture and grease and said barrier means is a P.V.A. adhesive.

7. The box of claim 1 wherein said venting means is in the order of substantially one square inch for each cubic foot enclosed within said box.

8. The box of claim 1 wherein said venting means is formed by holes in said box.

9. The box of claim 1 wherein said venting means is integrally formed by an enlargement in selvage which is cut from said box during the formation of a blank from which said box is erected.

* * * * *